US012366426B2

(12) United States Patent
Vanhatalo

(10) Patent No.: US 12,366,426 B2
(45) Date of Patent: Jul. 22, 2025

(54) SOUND SUPPRESSOR FOR A SHOTGUN

(71) Applicant: Silention Oy, Oulu (FI)

(72) Inventor: Miika Vanhatalo, Lasikangas (FI)

( * ) Notice: Subject to any disclaimer, the term of this patent is extended or adjusted under 35 U.S.C. 154(b) by 0 days.

(21) Appl. No.: 18/542,864

(22) Filed: Dec. 18, 2023

(65) Prior Publication Data

US 2024/0200897 A1 Jun. 20, 2024

(30) Foreign Application Priority Data

Dec. 20, 2022 (FI) ..... 20227166

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 6,374,718 B1 * 4/2002 Rescigno ..... F41A 21/30 89/14.4
8,555,765 B2 10/2013 Graham, II et al.
9,097,482 B1 * 8/2015 Holden ..... F41A 21/30
2011/0067950 A1 * 3/2011 Shults ..... F41A 21/30 29/428
2016/0238335 A1 * 8/2016 Bertschinger ..... F41A 21/30
2017/0191780 A1 * 7/2017 Barrett ..... F41A 21/325
2018/0283822 A1 * 10/2018 Johansen ..... F41A 21/30
2019/0186859 A1 * 6/2019 Sautmann ..... F41A 21/30
2019/0242668 A1 * 8/2019 Barrett ..... F41A 21/28
2021/0102774 A1 * 4/2021 Vanhatalo ..... F41A 21/325
2023/0003479 A1 * 1/2023 Berg ..... F41A 21/34
2024/0200897 A1 * 6/2024 Vanhatalo ..... F41A 21/30

FOREIGN PATENT DOCUMENTS

EP 2977708 A1 1/2016
EP 3382318 B1 5/2021

* cited by examiner

*Primary Examiner* — Troy Chambers
*Assistant Examiner* — Benjamin S Gomberg
(74) *Attorney, Agent, or Firm* — BelayIP

(57) ABSTRACT

A sound suppressor for a shotgun comprising a barrel is disclosed. The sound suppressor includes an outer frame, an inner hollow body including openings, a gas expansion area and a barrel attachment arrangement for attaching the sound suppressor onto the barrel. The sound suppressor is configured in such a way that when the sound suppressor is in use, the barrel is inside the outer frame and the shot of the shotgun passes through the inner hollow body, and the gases from the exploding propellant expand into the gas expansion area. The barrel attachment arrangement includes a first attachment part, a second attachment part, and a moving arrangement. The first attachment part is fixed to the frame, and the second attachment part is moved by the moving arrangement, which presses against the barrel to hold the sound suppressor in place.

14 Claims, 2 Drawing Sheets

SOUND SUPPRESSOR FOR A SHOTGUN

CROSS REFERENCE TO RELATED APPLICATIONS

This application claims the benefit of priority to Finnish Patent Application FI20227166, filed Dec. 20, 2022, the content of which is incorporated by reference.

BACKGROUND OF THE INVENTION

Field of the Invention

The invention relates to a sound suppressor for a shotgun comprising a barrel having a longitudinal axis of the barrel. The sound suppressor comprises an outer frame, an inner hollow body, and a gas expansion area. The outer frame comprises a first end of the outer frame, a second end of the outer frame and a shot opening at the second end of the outer frame. The inner hollow body comprises a casing of the hollow body, a first end of the hollow body, the second end of the hollow body, a first aperture and a second aperture. The inner hollow body comprises a straight longitudinal mid-axis and the casing of the inner hollow body comprises a plurality of openings extending through the casing. The outer frame comprises a first surface and a second surface, and the inner hollow body is positioned inside the outer frame in such a way that the mid-axis is nearer to the first surface than to the second surface, and the gas expansion area is located between the inner hollow body and the second surface.

Description of Related Art

A shotgun is a long-barrelled firearm designed to shoot a straight-walled cartridge known as a shotshell or shell, which usually discharges numerous small pellet-like spherical sub-projectiles called shot, or sometimes a single solid projectile called a slug. Shotguns are most commonly smoothbore firearms, meaning that their gun barrels have no rifling on the inner wall, but rifled barrels for shooting slugs are also available.

Many shotguns use a constriction in the end of the barrel known as a choke. The choke is used to tailor the pattern for different purposes. Chokes may either be formed as part of the barrel at the time of manufacture, by squeezing the end of the bore down over a mandrel, or by threading the barrel and screwing in an interchangeable choke tube. The choke typically consists of a conical section that smoothly tapers from the bore diameter down to the choke diameter, followed by a cylindrical section of the choke diameter. For example, some interchangeable shotgun chokes, use a conical portion about three times the bore diameter in length, so the shot is gradually squeezed down with minimal deformation. The cylindrical section is shorter, usually 0.6 to 0.75 inches (15 to 19 millimetres). The use of interchangeable chokes has made it easy to tune the performance of a given combination of shotgun and shotshell to achieve the desired performance.

Sound suppressors for firearms are well known and are usually designed for use with guns and handguns. Most different designs and designs have been proposed for firearms that fire one projectile at a time, that is, conventional one-piece projectiles, and where the initial speeds of these are either supersonic or subsonic. When using supersonic projectiles, the sound suppressor must, over at least a part of its length and interior, typically be formed with several expansion chambers arranged after each other, to permit expansion of exhaust gases, thereby reducing expansion noise and often, the visible flash from the suppressor's muzzle. Such expansion chambers are usually formed with transversal baffles, where the space between the baffles provides the required expansion volume or the required expansion volumes in the sound suppressor.

The through-going bore in the sound suppressor, through which the projectile passes when the firearm is discharged, is somewhat larger than the largest diameter of a projectile passing through the suppressor, to prevent dangerous situations from occurring, for example, by deflecting the path of the projectile. The smaller the clearance is between the diameter of the through-going bore and the projectile, the greater the sound suppression through the suppressor. However, the sound suppression must be balanced against the production tolerances of the suppressor, in order to prevent the projectile from coming into contact with the through-going bore.

Since a shotgun shell comprises a number of elements, such as a larger or smaller number of shot, a plastic cup or felt plug and wad, and thus can be considered a multi-part projectile, and where these different elements will come apart inside a suppressor, it has been a challenge to design a suppressor that reduces the sound efficiently. The standard solution for shotgun sound suppression has been a ported barrel that contains the shot column and surrounds the barrel with a layer of material that causes turbulence in the trapped gasses and delays their release back into the barrel after discharge of the projectile. Shotguns deliver their projectiles and gasses at supersonic speeds. Therefore, conventional suppressor designs are more suited for sonic and subsonic projectiles, such as bullets, and are not particularly successful when used on shotguns. Nor are baffle-type suppressor designs suitable for shotguns. Lack of safe containment of the shot and wad mass flying freely in the baffle section precludes close clearances. With greater projectile to baffle clearance, attenuation is very poor.

Patent publication U.S. Pat. No. 6,374,718 discloses a sound suppressor for a shotgun comprising a tubular metal body, a front-end closure having a projectile exit guide, and a rear-end closure having a barrel mounting element. A plurality of conical baffles with metal guide bushings are serially positioned in the body and arranged coaxially with the bore of the shotgun barrel. The guides are spaced apart a distance less than the axial length of the shot cup of the shotgun projectile. An expansion chamber is provided in the body rearwardly of the muzzle where the muzzle gasses are initially discharged into the suppressor body.

Patent publication EP3382318 discloses a sound suppressor for a shotgun. The suppressor comprises an outer housing and an inner hollow body arranged inside the outer housing. The outer housing comprises a main part and a first and second end part connected to the main part, where the inner hollow body is further provided with a number of longitudinal elevations extending over the length of the inner hollow body. The longitudinal elevations are arranged at a distance from each other around an inner circumference of the inner hollow body, where between two adjacent longitudinal elevations and over the length of the inner hollow body are provided a number of openings arranged at a certain distance from each other.

Patent publication EP2977708 discloses a sound suppressor for a shotgun comprising a rear end cap, a plurality of baffle units, and a front-end cap that are configured to be assembled in an end-to-end manner. These elements may be secured to each other with one or more elongated coupling elements that extend through the end-to-end arrangement, along with one or more securing elements. A plurality of guide rods extends through the interior of the sound suppressor in a manner that provides the framework for a passage for the shotgun projectile as it moves through the sound suppressor.

Patent publication U.S. Pat. No. 8,555,765 presents devices for attaching or removing a sound suppressor to or from a firearm. The device has a mount body threadedly attachable onto a muzzle attachment device that is attached to the muzzle of the gun. A locking spring extends around a portion of the mount body and it has serrated pawls for engaging a portion of the muzzle attachment device. An annular, rotatable locking collar attaches to the mount body and extends over the locking spring. As the locking collar is rotated, a reduction in diameter of the inner surface of the locking collar can urge the pawl into secured contact with the muzzle attachment device.

There is a clear need for a sound suppressor for shotguns that is efficient, easy and safe to operate. Also, using the sound suppressor should not decrease the usability of the shotgun.

BRIEF SUMMARY OF THE INVENTION

An object of the invention is a solution that can significantly reduce the disadvantages and drawbacks of the prior art. In particular, the object of the invention is an improved sound suppressor for a shotgun.

The objects of the invention are attained with a device that is characterized by what is stated in the independent patent claim. Some advantageous embodiments of the invention are disclosed in the dependent claims.

The invention is a sound suppressor for a shotgun comprising a barrel. The sound suppressor comprises an outer frame, an inner hollow body comprising openings, a gas expansion area and a barrel attachment arrangement for attaching the sound suppressor onto the barrel. The sound suppressor is configured in such a way that when the sound suppressor is in use, the barrel is inside the outer frame and the shot passes through the inner hollow body, and the gases from the shotgun blast expand into the gas expansion area. The barrel attachment arrangement comprises a first attachment part, a second attachment part, and a moving arrangement. The first attachment part is fixed to the frame, and the second attachment part is moved by the moving arrangement to be pressed against the barrel so that it holds the sound suppressor.

When reference is made in the text to the upper or the lower parts or respective directions such as down or up, or vertical or horizontal directions, a situation is described in which the sound suppressor according to the invention is in use and is attached to a shotgun. The directions are related to the shotgun. Also, when reference is made to the front, rear, top or side parts or directions, the sound suppressor is placed similarly onto the shotgun.

The present invention relates to a sound suppressor for a shotgun comprising a barrel and the barrel has a longitudinal axis of the barrel. The sound suppressor comprises an outer frame, an inner hollow body, and a gas expansion area. The outer frame comprises a first end of the outer frame, a second end of the outer frame and a barrel opening at the second end of the outer frame. The inner hollow body comprises a casing of the hollow body, a first end of the hollow body, the second end of the hollow body, a first aperture and a second aperture. The inner hollow body comprises a straight longitudinal mid-axis and the casing of the inner hollow body comprises a plurality of openings extending through the casing. The outer frame comprises a first surface and a second surface. The inner hollow body is positioned inside the outer frame in such a way that the mid-axis is nearer to the first surface than to the second surface. The gas expansion area is located between the inner hollow body and the second surface. In one advantageous embodiment of the invention, the first end of the outer frame comprises a barrel opening, and the sound suppressor is configured in such a way that when the sound suppressor is in use, the barrel extends into the sound suppressor through the barrel opening and is attached to the inner hollow body in such a way that the longitudinal axis of the barrel and the mid-axis of the inner hollow body are parallel. The sound suppressor further comprises a barrel attachment arrangement for attaching the sound suppressor onto the barrel. The barrel attachment arrangement comprises two attachment parts: a first attachment part and a second attachment part, and a moving arrangement. The first attachment part is fixed to the outer frame, and the second attachment part is configured to be moved by the moving arrangement in relation to the first attachment to a position where the second attachment part is pressed against the barrel when the sound suppressor is in use.

In an embodiment, the barrel attachment arrangement is between the barrel and the second surface, when the sound suppressor is attached to the shotgun.

In a second embodiment, the sound suppressor further comprises a barrel attachment chamber, and at least the first attachment part and the second attachment part are placed inside the barrel attachment chamber, and the barrel attachment chamber is separated from the gas expansion area.

In a third embodiment, the inner hollow body comprises a choke part at the first end of the hollow body, and the choke part is configured to fit inside the barrel when the sound suppressor is in use.

In a fourth embodiment, the length of the portion of the barrel that is inside the outer frame when the sound suppressor is attached to the shotgun amounts to 25 to 75% of the total length of the sound suppressor, i.e. the distance between the first end of the outer frame and the second end of the outer frame.

In a fifth embodiment, the shot opening and the second aperture are circular and they converge, and the second end of the inner hollow body is fixed to the second end of the outer frame.

In a sixth embodiment, the openings in the casing of the inner hollow body are located between the second end of the inner hollow body and the barrel when the sound suppressor is in use.

In a seventh embodiment, the gas expansion area comprises baffle plates, and the baffle plates serve to divide the gas expansion area into several expansion chambers. In an eighth embodiment, the baffle plates are perpendicular to the mid-axis of the inner hollow body. In a ninth embodiment, the baffle plates comprise baffle plate openings extending through the baffle plates.

In a tenth embodiment, the first attachment part and the second attachment part comprise sloping surfaces, and the moving arrangement is configured to push against and release the second attachment part, and the sloping surfaces are positioned in such a way that when the second attachment part is pushed against, the distance between the second attachment part and the barrel is decreased. In an eleventh embodiment, the moving arrangement comprises an elongated object that extends outside of the first end of the outer frame, and the object is movable in a direction parallel to the mid-axis of the inner hollow body. In a twelfth embodiment, the barrel attachment arrangement comprises a spring element connected to the second attachment part, and the spring element is configured to push the second attachment part towards the first end of the outer frame when the moving arrangement releases the second attachment part.

In a thirteenth embodiment, the shotgun barrel has an upper surface and on the upper surface is a shotgun accessory device or devices, for example, a sight or a rail, and the outer frame comprises an elongated slot, and the slot is configured to receive said device when the sound suppressor is attached to the shotgun. In a fourteenth embodiment, the slot is on the first surface and is straight and extends from the barrel opening towards the second end of the outer frame.

An advantage of the invention is that it provides an efficient sound suppressor for shotguns.

It is an advantage of the invention that it improves the attachment of the sound suppressor.

It also improves safety and decreases the possibility of damage to the shotgun and the sound suppressor.

It is a further advantage of the sound suppressor that it is easy to manufacture and it can be easily and flexibly adjusted to accommodate different shotguns and shotgun usage scenarios.

The sound suppressor according to the invention also keeps the centre of gravity of the shotgun closer to normal in comparison to known sound suppressors. Also, the path of the shot through the sound suppressor according to the invention is shorter than the paths in the known sound suppressors.

BRIEF DESCRIPTION OF THE SEVERAL VIEWS OF THE DRAWINGS

In the following, the invention is described in detail. The description refers to the accompanying drawings, wherein.

DETAILED DESCRIPTIONS OF THE INVENTION

The embodiments in the following description are given as examples only and someone skilled in the art can carry out the basic idea of the invention also in some other way than what is described in the description. Though the description may refer to a certain embodiment or embodiments in several places, this does not mean that the reference would be directed towards only one described embodiment or that the described characteristic would be usable only in one described embodiment. The individual characteristics of two or more embodiments may be combined and new embodiments of the invention may thus be provided.

Figure 1:
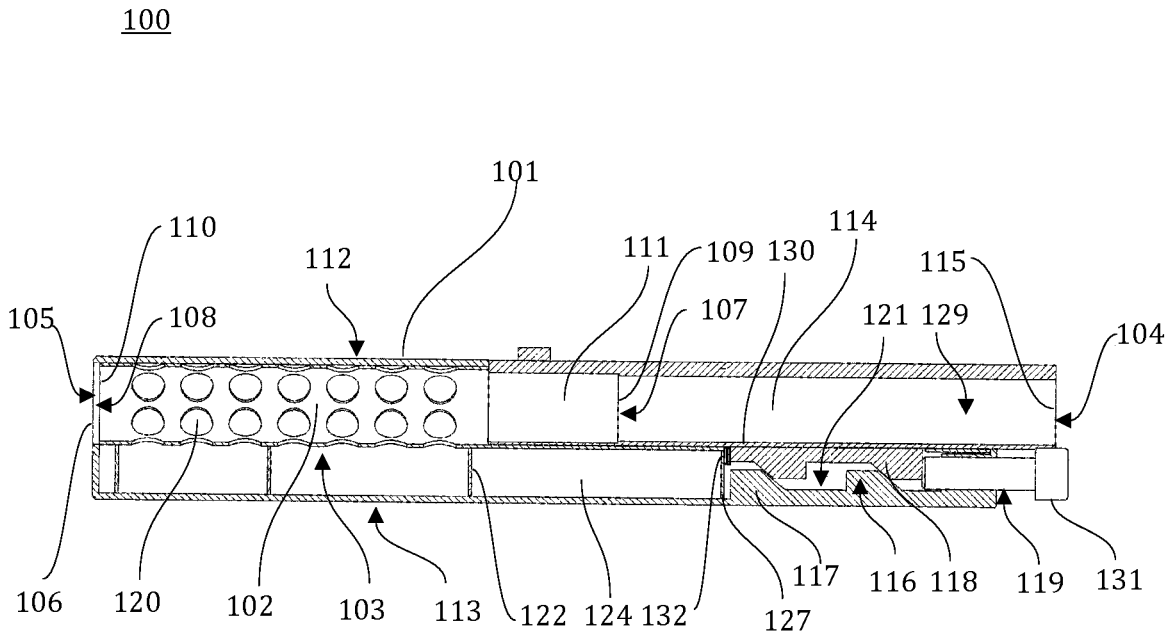
FIG. 1 depicts an example of a sound suppressor according to an embodiment.

FIG. 1 shows an embodiment of a sound suppressor 100 for a shotgun according to invention as a longitudinal cross-section. The sound suppressor is an elongated body having a casing, a first end of the sound suppressor and a second end of the sound suppressor. In this embodiment, the cross-section of the sound suppressor is circular, i.e. the sound suppressor is a circular cylinder. In some embodiments, the cross-section may be shaped differently, for example taking an elliptical shape or a combination of several geometrical shapes. The shotgun is attached to the sound suppressor at the first end of the sound suppressor. The shotgun comprises a barrel 114 and a bore of the barrel, and the barrel has a longitudinal axis of the barrel. The shotgun and the barrel have an upper side and a lower side. These directions refer to a position where the shotgun is resting on a surface in a normal shooting position, for example, the sight of the shotgun is on the upper side and the trigger is on the lower side. When the sound suppressor is attached to the shotgun, the barrel is partly inside the sound suppressor. In some embodiments, the length of the portion of the barrel that goes inside the sound suppressor amounts to 25 to 75% of the total length of the sound suppressor, i.e. the distance between the first end of the sound suppressor and the second end of the sound suppressor. The sound suppressor comprises a barrel receiving area 129 that is configured to receive the barrel of the shotgun when the sound suppressor is prepared for use.

The sound suppressor 100 comprises an outer frame 101, an inner hollow body 102, a gas expansion area 103, and a barrel attachment arrangement 116. The outer frame forms a casing of the sound suppressor, and it surrounds the inner parts of the sound suppressor. The inner hollow body is configured in such a way that when the sound suppressor is in use, i.e. when the sound suppressor is attached to the barrel 114 of the shotgun, the shot passes through the inner hollow body and at the same time through the entire sound suppressor. The gas expansion area comprises free space where gases from the exploding propellant will expand, thus suppressing the sound of the blast. The barrel attachment arrangement comprises a part that is movable in such a way that it has a position where said part is in contact with the surface of the barrel. The shape and the material of said barrel attachment arrangement part is chosen in such a way that there is enough friction between the surface of the part and the surface of the barrel for holding the sound suppressor in place on the barrel of the shotgun.

The outer frame 101 comprises a first end of the outer frame 104, a second end of the outer frame 105, a shot opening 106 at the second end of the outer frame, and a barrel opening 115 at the first end of the outer frame. The outer frame further comprises a first surface 112 and a second surface 113. The outer frame forms the casing of the sound suppressor 100, and the first end of the outer frame is the first end of the sound suppressor, and the second end of the outer frame is the second end of the sound suppressor. When the sound suppressor is attached onto the shotgun, the first surface is on the upper side of the shotgun and the second surface are at the lower side of the shotgun. The outer frame serves to protect and support the inner parts of the sound suppressor and it forms at least some of the walls of the gas expansion area 103. The outer frame can comprise one (for example 3D-printed parts) or more parts that are fixed together.

The inner hollow body 102 comprises a casing of the inner hollow body, a first end of the inner hollow body 107, the second end of the inner hollow body 108, a first aperture 109, a second aperture 110 and a choke part 111 at the first end of the inner hollow body. The inner hollow body comprises a straight longitudinal mid-axis, and the casing of the inner hollow body comprises a plurality of openings 120 extending through the casing. The inner hollow body is a cylinder having a circular cross-section. The first aperture is at the first end of the inner hollow body, and the second aperture is at the second end of the inner hollow body. Between the first aperture and the second aperture is a straight path through the inner hollow body. The shots from the shotgun follow this path. The second aperture is connected to the shot opening 106 at the second end of the outer frame 105, i.e. the shot from the shotgun exits the sound suppressor 100 from the shot opening when the sound suppressor is in use. In this embodiment, the openings in the casing of the inner hollow body are circular, but naturally, the openings can assume a different shape, such as ellipses or slots or some combination of shapes. The openings in the casing of the inner hollow body are between the second end of the inner hollow body 108 and the barrel when the sound suppressor is in use. In this embodiment, the choke part is configured to fit inside the bore of the barrel 114 when the sound suppressor 100 is in place. The choke part inside the barrel works as a choke for the shotgun. In some embodiments, the shotgun comprises a choke and the first end of the inner hollow body is attached onto the choke or onto the barrel. In some embodiments, the inner hollow body near the first end of the inner hollow body is shaped in such a way that the barrel fits inside the inner hollow body. In all embodiments, the barrel is inserted into the outer frame 101 through the barrel opening 115.

Figure 2:
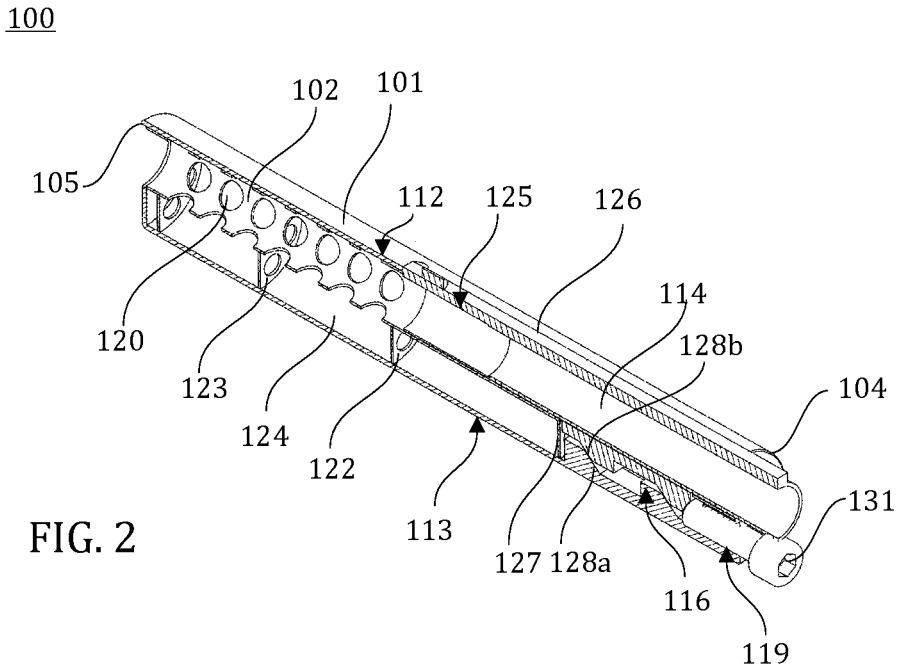
FIG. 2 depicts the sound suppressor presented in FIG. 1.

The inner hollow body 102 is positioned in such a way that the longitudinal axis of the barrel and the mid-axis of the inner hollow body are parallel, and that its mid-axis is nearer to the first surface than to the second surface. This means that the sound suppressor extends below the barrel 114 when the sound suppressor is attached onto the shotgun. The gas expansion area 103 is in at least partly inside this area, i.e. the gas expansion area is mainly between the inner hollow body and the second surface 113. The gas expansion area also extends below the barrel when the sound suppressor is in use. The outer frame 101 forms at least part of the walls of the gas expansion area. In the gas expansion area are one or more baffle plates 122. The baffle plates comprise baffle plate openings, and the baffle plate openings 123 (as seen in FIG. 2) extend through the baffle plates. In this embodiment, the baffle plates are positioned vertically inside the gas expansion area, i.e. the baffle plates are perpendicular to the mid-axis of the inner hollow body and the longitudinal axis of the barrel 114. The baffle plates divide the gas expansion area into several expansion chambers 124. In this embodiment, there are four expansion chambers. The first expansion chamber from the first end of the sound suppressor is the smallest of said chambers. The second and the third expansion chambers are connected to the inner hollow body through the openings 120 extending through the casing of the inner hollow body. The fourth expansion chamber is below the barrel 114 or area between the barrel and the second surface 113. The fourth expansion chamber is connected only to the third expansion chamber through the baffle plate openings 123 in the baffle plate between the third and the fourth expansion chamber. In this embodiment, the fourth expansion chamber comprises surrounding walls. There is a wall between the barrel (when the barrel is inside the sound suppressor) and the fourth expansion chamber.

The baffle plates 122 guide the gas flows inside the gas expansion area 103. Also, the baffle plates support the internal structures and integrity of the sound suppressor 100. In this embodiment, when the exploding propellant gases expand from the inner hollow body 102 into the gas expansion area, they first enter the second and then the third expansion chamber 124. The gases enter the first chamber from the second chamber and almost immediately reflect back to the second chamber due to the small volume of the first chamber. This directs the main gas flow direction towards the fourth expansion chamber that leaves no other escape path than the baffle openings 123 in the baffle plate between the third and the fourth expansion chambers. When the gas pressure in the third expansion chamber cannot force more gases into the fourth expansion chamber, the direction of the gas flow reverses. Also, at the same time, the gas pressure inside the inner hollow body 102 decreases and the gases start to flow back into the inner hollow body from the second and the third expansion chambers, and from the inner hollow body through the second aperture 110 and the shot opening 106, out of the sound suppressor. It must be noted that there are embodiments where the baffle plates are positioned differently, and gas flows behave differently. Also, in some embodiments, the gas expansion area 103 is has no baffle plates and the gas flows inside the gas expansion area are directed with shapes on the walls of the gas expansion area.

In the area between the barrel 114 and the second surface 113 is a barrel attachment chamber 121 in which the barrel attachment arrangement 116 is positioned at least partly. The barrel attachment chamber is separated from the gas expansion area 103 at least by a barrel attachment chamber wall 127. The barrel attachment chamber wall is in this embodiment between the fourth expansion chamber 124 and the barrel attachment chamber. The barrel attachment chamber is open to the barrel receiving area 129, i.e. there is an opening 130 between the barrel attachment chamber and the barrel receiving area. When the barrel is inserted into the barrel receiving area, the surface of the barrel closes said opening and the barrel attachment chamber is sealed from the other parts of the inner areas of the sound suppressor 100. This means that the explosion gases cannot enter the barrel attachment chamber.

The barrel attachment arrangement 116 comprise two attachment parts: a first attachment part 117 and a second attachment part 118, and a moving arrangement 119. The first attachment part is fixed to the outer frame 101 or it is formed by shaping the inner surface of the outer frame. The second attachment part is configured to be moved by the moving arrangement in relation to the first attachment to a position where the second attachment part is pressed against the barrel through the opening 130 between the barrel attachment chamber 121 and the barrel receiving area 120. The second attachment part comprises an attachment surface. The attachment surface is configured to be in contact with the surface of the barrel.

Advantageously, the attachment surface is shaped to correspond to the shape of the surface of the barrel. The chosen material of the second attachment part and the shape of the attachment surface are such that there is sufficient friction between the second attachment part and the barrel to keep the sound suppressor 100 in the operational position, i.e. keeping the sound suppressor and the barrel relatively immobile in relation to each other while the shotgun is in normal use. The inventor has discovered that when the attachment surface has a length that amounts to 15% of the length of the barrel residing inside the sound suppressor, it is quite adequate, while it is possible to use an even shorter attachment surface. However, due to safety considerations and ease of use, it is recommended to keep the attachment surfaces of the second attachment parts longer.

The moving arrangement 119 extends outside of the barrel attachment chamber 121 so it can be adjusted by the user of the sound suppressor 100. In this embodiment, the moving arrangement is a bolt-like elongated object 131 comprising a head and a shaft. The moving arrangement is configured to be moved by rotating the head. When the moving arrangement is inserted into the sound suppressor, the shaft pushes the second attachment part 118 towards the first attachment part 117, and the second attachment part 118 rises towards the opening 130 and towards the barrel 114 inside the barrel receiving area 129. When the moving arrangement is moved outwards, the second attachment part is released. In some embodiments, the barrel attachment arrangement 116 further comprises a spring element 132 that is configured to push the second attachment part towards the first end of the sound suppressor when the moving arrangement does not press against the second attachment part. The moving part goes through the outer frame 101 at the first end 104 of the outer frame. The moving part is below the lower side of the barrel. The moving part and the outer frame are designed in such a way that the moving part does not accidentally become loose.

FIG. 2 shows the longitudinal cross-section of the sound suppressor 100 as seen from above.

The outer frame 101 comprises a slot 126 on the first surface 112 of the sound suppressor 100. In this embodiment, the slot is straight and extends from the first end of the sound suppressor towards the second end of the sound suppressor, i.e. from the first end 104 of the outer frame towards the second end 105 of the outer frame. The slot extends through the casing of the outer frame. The barrel 114 of the shotgun comprises some accessory attachments 125 on the upper side of the barrel, such as a mounting rail or a sight. The width and the shape of the slot are designed in such a way that when the barrel is inserted into the sound suppressor, the accessory attachments fits into the slot, and in some embodiments, extend to the first surface in such a way that at least some of accessory attachments can be freely used by the user of the shotgun to which the sound suppressor is attached. The length of the slot is such that the sound suppressor is fully in place, i.e. properly attached when the accessory attachments or some part of them have reached the end of the slot. In the embodiment presented in FIGS. 1 and 2, said accessory attachment is the sight of the shotgun.

In this embodiment, the first attachment part and the second attachment part of the barrel attachment arrangement 116 comprise sloped structures. The first attachment part comprises a first attachment part sloped structure 128*a* and the second attachment part comprises a second attachment part sloped structure 128*b*. The first attachment part sloped structure comprises two extensions having sloped surfaces that rise in the direction from the first end 104 of the outer frame towards the second end 105 of the outer frame. By rising surfaces, it is meant here that the ends of the sloped surfaces that are closer to the first end 104 of the outer frame than to the second end of the outer frame are closer to the second surface 113 and the sloped surfaces are closer towards the first surface 112. The second attachment part sloped structure comprises two extensions having sloped surfaces. Said sloped surfaces are positioned in an opposite way to the sloped surfaces on the first attachment part, i.e. the sloped surfaces on the second attachment part are pointing in the same direction as the sloped surfaces on the first attachment part, but they are closer towards the second surface 113. When the second attachment part is pushed by the moving arrangement 119 towards the second end 105 of the outer frame, the sloped surfaces of the second attachment part slide over the sloped surfaces of the first attachment part and this lifts the second attachment part up towards the second surface 112 and the barrel 114. Moving of the moving arrangement is implemented by rotating the elongated object 131. The barrel attachment chamber is shaped in such a way that the second attachment part has sufficient room to move to come in contact with the barrel. Especially the barrel attachment chamber wall 127 between the barrel attachment chamber and the fourth expansion chamber 124 is positioned in such a way that allows the second attachment part to move sufficiently towards the second end of the outer frame to be lifted to come in contact with the barrel.

The gas expansion area is divided into expansion chambers 124 by the baffle plates 122. The baffle plates comprise baffle plate openings 123 for guiding the explosion gas flows in the gas expansion area and the gas flows between the inner hollow body 102 and the gas expansion area. In this embodiment, the expansion chamber closest to the first end of the sound suppressor 100 comprises gas flow paths only in the baffle plate separating said expansion chamber and the adjacent expansion chamber. In some embodiments, the baffle plates are positioned differently. The gas expansion area extends to area between the barrel 114 and the second surface 112.

Figure 3:
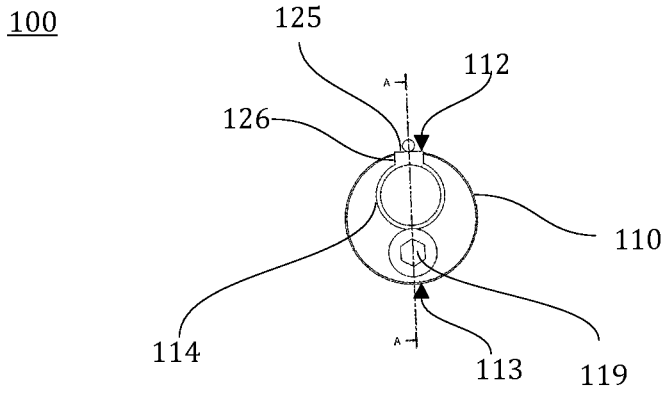
FIG. 3 depicts a vertical cross-section of the sound suppressor further to FIG. 1.

FIG. 3 shows the sound suppressor 100 as seen from the direction of the shotgun, i.e. from the direction of the first end of the sound suppressor. The barrel 114 of the shotgun is inserted into the sound suppressor through the barrel opening at first end of the sound suppressor. The sound suppressor comprises the first surface 113 and the second surface 113, and said surfaces are on opposite sides of the sound suppressor. When the sound suppressor is attached to the shotgun, the first surface is located on the same side as the upper side of the shotgun. The moving arrangement 119 is located between the barrel and the second surface. The part that is used for controlling the position the moving arrangement, and which at the same time controls the barrel attachment arrangement, is located on the outer surface of first end of the sound suppressor. The slot 126 that is configured to receive the accessory attachments 125 is located at the first surface 113.

Some advantageous embodiments of the trampoline according to the invention have been described above. The invention is however not limited to the embodiments described above, but the inventive idea can be applied in numerous ways within the scope of the claims.

What is claimed is:

1. A sound suppressor for a shotgun, comprising:

an outer frame comprising a first end of the outer frame, a second end of the outer frame, a shot opening at the second end of the outer frame, a first surface, and a second surface;

an inner hollow body comprising a casing, a first end of the inner hollow body, a second end of the inner hollow body, a first aperture, a second aperture, and a longitudinal mid-axis, and a plurality of openings extending through the casing;

a gas expansion area located between the inner hollow body and the second surface; and a barrel attachment arrangement comprising a first attachment part, a second attachment part, and a moving arrangement;

wherein the inner hollow body is arranged inside the outer frame such that the mid-axis is located nearer to the first surface than to the second surface, wherein the first end of the outer frame comprises a barrel opening configured for a barrel of the shotgun to be inserted into the outer frame through the barrel opening and attached to the inner hollow body, such that a longitudinal axis of the barrel and the mid-axis of the inner hollow body are parallel, and wherein the first attachment part is fixed to the outer frame and the second attachment part is configured to be moved, by the moving arrangement, in relation to the first attachment part to a position where the second attachment part is pressed against the barrel when the barrel is inserted into the outer frame, and wherein the barrel attachment arrangement is arranged between the barrel and the second surface, when the barrel is inserted into the outer frame.

2. The sound suppressor according to claim 1, wherein:

the sound suppressor further comprises a barrel attachment chamber, at least the first attachment part and the second attachment part are arranged inside the barrel attachment chamber, and the barrel attachment chamber is arranged separate from the gas expansion area.

3. The sound suppressor according to claim 1, wherein the inner hollow body comprises a choke part at the first end of the inner hollow body, the choke part configured to fit into the barrel.

4. The sound suppressor according to claim 1, wherein a length of the portion of the barrel configured to extend inside the outer frame amounts to 25 to 75% of a distance between the first end of the outer frame and the second end of the outer frame.

5. The sound suppressor according to claim 1, wherein:

the shot opening and the second aperture are circular and are arranged to converge, and the second end of the inner hollow body is fixed to the second end of the outer frame.

6. The sound suppressor according to claim 1, wherein the openings in the casing of the inner hollow body are arranged between the second end of the inner hollow body and the barrel when the barrel is inserted into the outer frame.

7. The sound suppressor according to claim 1, wherein the gas expansion area further comprises baffle plates configured and arranged to divide the gas expansion area into several expansion chambers.

8. The sound suppressor according to claim 7, wherein the baffle plates are arranged perpendicular to the mid-axis of the inner hollow body.

9. The sound suppressor according to the claim 7, wherein the baffle plates further comprise baffle plate openings extending through the baffle plates.

10. The sound suppressor according to claim 1, wherein:

the first attachment part and the second attachment part comprise sloped surfaces, the moving arrangement is configured to push against and release the second attachment part, and the sloped surfaces are arranged such that when the second attachment part is pushed against, a distance between the second attachment part and the barrel decreases when the barrel is inserted into the outer frame.

11. The sound suppressor according to claim 10, wherein the moving arrangement further comprises an elongated object arranged extending outside of the first end of the outer frame and configured to move in a direction parallel to the mid-axis of the inner hollow body.

12. The sound suppressor according to claim 10, wherein the barrel attachment arrangement further comprises a spring element connected to the second attachment part, and the spring element is configured to push the second attachment part towards the first end of the outer frame when the moving arrangement releases the second attachment part.

13. The sound suppressor according to claim 1, wherein:

the barrel further comprises an upper surface and an accessory device or devices arranged on the upper surface, the device or devices comprising a sight or a mounting rail, and the outer frame comprises an elongated slot configured to receive the device or devices when the barrel is inserted into the outer frame.

14. The sound suppressor according to the claim 13, wherein the slot is arranged on the first surface and extends linearly from the barrel opening towards the second end of the outer frame.

* * * * *